US007779557B2

(12) United States Patent
Teteriatnikov et al.

(10) Patent No.: US 7,779,557 B2
(45) Date of Patent: Aug. 24, 2010

(54) SHOE

(75) Inventors: Savva Teteriatnikov, Venice, CA (US); Eckhard Knoepke, Redondo Beach, CA (US); Julie Zhu, Redondo Beach, CA (US)

(73) Assignee: Skechers U.S.A., Inc. II, Manhattan Beach, CA (US)

( * ) Notice: Subject to any disclaimer, the term of this patent is extended or adjusted under 35 U.S.C. 154(b) by 0 days.

(21) Appl. No.: 12/557,276

(22) Filed: Sep. 10, 2009

(65) Prior Publication Data

US 2010/0146819 A1 Jun. 17, 2010

Related U.S. Application Data

(60) Provisional application No. 61/122,911, filed on Dec. 16, 2008.

(51) Int. Cl.
*A43B 13/12* (2006.01)
*A43B 13/14* (2006.01)

(52) U.S. Cl. ..... 36/25 R; 36/30 R; 36/31

(58) Field of Classification Search ..... 36/25 R, 36/27, 28, 30 R, 31, 88, 117.4, 102, 103, 36/114; 156/245; 264/238
See application file for complete search history.

(56) References Cited

U.S. PATENT DOCUMENTS 4,348,821 A 9/1982 Daswick
4,399,620 A 8/1983 Funck
4,798,010 A 1/1989 Sugiyama
5,025,573 A * 6/1991 Giese et al. ..... 36/30 R
5,191,727 A 3/1993 Barry et al.
5,528,842 A 6/1996 Ricci
5,572,805 A * 11/1996 Giese et al. ..... 36/30 R
5,592,757 A 1/1997 Jackinsky
5,718,064 A 2/1998 Pyle
5,822,886 A 10/1998 Luthi et al.
6,038,790 A * 3/2000 Pyle et al. ..... 36/30 R
6,341,432 B1 1/2002 Muller
6,578,290 B1 6/2003 Meynard
6,662,469 B2 12/2003 Belley et al.
6,729,046 B2 5/2004 Ellis, III
6,782,639 B1 8/2004 Muller
7,010,867 B2 3/2006 Brown
7,287,341 B2 10/2007 Ellis, III
7,461,470 B2 * 12/2008 Dardinski et al. ..... 36/100

(Continued)

FOREIGN PATENT DOCUMENTS

EP 0 999 764 B1 5/2003

(Continued)

*Primary Examiner*—Marie Patterson
(74) *Attorney, Agent, or Firm*—Kleinberg & Lerner, LLP; Marshall A. Lerner

(57) ABSTRACT

A shoe having a toe region, a middle region, a heel region, and a multi-layer, multi-density midsole wherein an upper layer of the midsole has a bottom surface that has a longitudinal convexity and a longitudinal concavity, the longitudinal convexity typically occupying a substantial portion of the toe region or a substantial portion of the toe region and middle region, and the longitudinal concavity typically occupying a substantial portion of the heel region, the longitudinal convexity and the longitudinal concavity collectively contributing to simulating the effect, and imparting the fitness benefits, of walking on a sandy beach or on a giving or uneven surface regardless of the actual hardness of the surface.

7 Claims, 9 Drawing Sheets

U.S. PATENT DOCUMENTS

| | | | | |
|---|---|---|---|---|
| 7,464,428 | B2 | 12/2008 | Norton | |
| 7,513,065 | B2 | 4/2009 | Kita et al. | |
| 7,562,468 | B2 | 7/2009 | Ellis, III | |
| 2004/0064973 | A1 | 4/2004 | Talbott | |
| 2004/0154188 | A1 | 8/2004 | Laska | |
| 2005/0086838 | A1 * | 4/2005 | Khantzis | 36/30 R |
| 2005/0091881 | A1 * | 5/2005 | Burgess | 36/30 R |
| 2006/0254093 | A1 | 11/2006 | Fuchslocher et al. | |
| 2008/0016724 | A1 | 1/2008 | Hlavac | |
| 2008/0163513 | A1 | 7/2008 | Chapman et al. | |
| 2008/0229624 | A1 | 9/2008 | Mueller et al. | |
| 2009/0031584 | A1 | 2/2009 | Rasmussen et al. | |
| 2009/0056165 | A1 | 3/2009 | Lee | |
| 2009/0077830 | A1 | 3/2009 | Lee | |
| 2009/0151201 | A1 | 6/2009 | Lee | |
| 2009/0183393 | A1 | 7/2009 | Lee | |

FOREIGN PATENT DOCUMENTS

| | | | |
|---|---|---|---|
| EP | 099974 | B1 | 7/2003 |
| EP | 1124462 | B1 | 9/2004 |
| EP | 1 124 462 | B1 | 10/2004 |
| EP | 2005067754 | A1 | 7/2005 |
| EP | 2 070 434 | A1 | 6/2009 |
| EP | 2 080 443 | A1 | 7/2009 |
| JP | 50-135334 | | 11/1975 |
| JP | 135334 | | 11/1975 |
| JP | 51-138237 | | 11/1976 |
| JP | 51138237 | | 11/1976 |
| JP | 57-81301 | | 5/1982 |
| JP | 57-188201 | | 11/1982 |
| JP | 57188201 | | 11/1982 |
| JP | 58-91906 | | 6/1983 |
| JP | 5891906 | | 6/1983 |
| JP | 58-165801 | | 9/1983 |
| JP | 58165801 | | 9/1983 |
| JP | 58-190401 | | 11/1983 |
| JP | 58190401 | | 11/1983 |
| JP | 60-150701 | | 8/1985 |
| JP | 60150701 | | 8/1985 |
| JP | 61-31101 | | 2/1986 |
| JP | 6131101 | | 3/1986 |
| JP | 61-154503 | | 7/1986 |
| JP | 61154503 | | 7/1986 |
| JP | 1-110603 | | 7/1989 |
| JP | 1110603 | | 7/1989 |
| JP | 2001-520528 | A | 10/2001 |
| JP | 520528 | A | 10/2001 |
| JP | 2006-204712 | A | 8/2006 |
| JP | 2006-247218 | A | 9/2006 |
| JP | 247218 | A | 9/2006 |
| JP | 204712 | A | 10/2006 |
| JP | 3917521 | | 2/2007 |
| JP | 5781301 | | 9/2009 |
| WO | WO 99/03368 | A1 | 1/1999 |
| WO | WO 01/15560 | A1 | 3/2001 |
| WO | WO 2005/067754 | A1 | 7/2005 |
| WO | WO 2008/143465 | A1 | 11/2008 |
| WO | WO 2009/061103 | A1 | 5/2009 |
| WO | WO2009061103 | A1 | 5/2009 |
| WO | WO 2009/069871 | A1 | 6/2009 |
| WO | WO 2009/069926 | A1 | 6/2009 |
| WO | WO 2009/075436 | A1 | 6/2009 |
| WO | WO 2009/082164 | A1 | 7/2009 |
| WO | WO 2009/091106 | A1 | 7/2009 |

* cited by examiner

SHOE

This application claims the benefit of priority based on Provisional Application No. 61/122,911 filed Dec. 16, 2008.

BACKGROUND OF THE INVENTION

1. Field of the Invention

The present invention relates to footwear and, in particular, to a shoe with fitness benefits. The fitness benefits are imparted by a unique walking action which is induced by the shoe's midsole. This midsole has multiple layers, multiple densities, a longitudinal convexity, and a longitudinal concavity. The induced walking action mimics the effect of walking on a sandy beach or on a giving or uneven surface.

2. Description of the Related Art

Shoes are designed for many purposes—from protection on the job, to performance during athletic activity on the track or court, to special occasions and everyday lifestyle. Shoes have also been used to promote physical health and activity. Increasingly, shoes have given users fitness benefits. Many shoes have attempted to provide users the benefit of improving the user's fitness by simply walking while wearing such shoes. However, there continues to be a need for such shoes that improve the user's health yet are comfortable and easy to use.

Walking is one of the easiest and most beneficial forms of exercise. When done properly and with the appropriate footwear, it strengthens the heart, improves cardiovascular health, increases one's stamina and improves posture. It also helps to strengthen one's muscles and maintain joint flexibility.

Prior art shoes have attempted to improve the user's fitness by mimicking walking barefoot. See, for example, U.S. Pat. No. 6,341,432 to Müller. Such shoes can include an abrupt, discrete pivot point provided by a hard inclusion. Consequently, in every step taken during normal walking while wearing such shoes, the user is forced to overcome this abrupt, discrete pivot point. This can result in significant pain and discomfort.

The present invention aims to provide a way of mimicking walking on a sandy beach or on a giving or uneven surface, while not inducing any pain or discomfort from doing so. By mimicking walking on a sandy beach and/or on an uneven surface, the present invention aims to significantly increase the fitness and health benefits of everyday walking by requiring the user to exert additional effort and energy while walking and to use muscles that the user otherwise would not use if wearing ordinary footwear, again all without inducing any pain or discomfort.

SUMMARY OF THE INVENTION

It is an object of the present invention to provide a shoe that mimics the effects, and imparts the fitness benefits, of walking on a sandy beach or on a giving or uneven surface without inducing any pain or discomfort from doing so. The present invention is a shoe comprising an upper, an outsole, and a midsole, each having a medial side and a lateral side. In a preferred embodiment, the midsole is affixed to the upper and the outsole is affixed to midsole. The upper, midsole, and outsole each has a frontmost point and a rearmost point substantially opposite the frontmost point. When the shoe is being worn by a user, each frontmost point and each rearmost point is oriented with respect to one another such that each frontmost point is closer to the user's toes than each rearmost point while at the same time each rearmost point is closer to the user's heel than each frontmost point.

The shoe has a front portion and a rear portion substantially opposite the front portion. When the shoe is being worn by a user, the front portion and the rear portion are oriented with respect to one another such that the front portion is closer to the user's toes than the rear portion while at the same time the rear portion is closer to the user's heel than the front portion.

The shoe has a front tip that is located at the farthest forward point of the shoe when moving from the rear portion to the front portion. The shoe has a rear tip that is located at the farthest rearward point of the shoe when moving from the front portion to the rear portion. In a preferred embodiment, the front tip coincides with the frontmost point of the upper, the frontmost point of the midsole, or the frontmost point of the outsole while the rear tip coincides with the rearmost point of the upper, the rearmost point of the midsole, or the rearmost point of the outsole. In a preferred embodiment, the frontmost point of the upper, the frontmost point of the midsole, and the frontmost point of the outsole are all located relatively close to one another while the rearmost point of the upper, the rearmost point of the midsole, and the rearmost point of the outsole are all located relatively close to one another.

The upper, midsole, and outsole each has a toe region. The toe region includes the region that extends substantially from the medial side to the lateral side at a location that begins in the vicinity of the front tip of the shoe and extends from there to a location that is approximately one third of the distance toward the rear tip of the shoe.

The upper, midsole, and outsole each has a heel region. The heel region includes the region that extends substantially from the medial side to the lateral side at a location that begins in the vicinity of the rear tip of the shoe and extends from there to a location that is approximately one third of the distance toward the front tip of the shoe.

The upper, midsole, and outsole each has a middle region. The middle region includes the region that extends substantially from the medial side to the lateral side at a location that extends approximately between the toe region and the heel region.

In a preferred embodiment, the midsole further comprises an upper layer and a lower layer, the upper layer having a first density and the lower layer having a second density different from the first density. The upper layer has a top surface and a bottom surface substantially opposite the top surface. The bottom surface has a single longitudinal convexity (as defined below) that occupies a substantial portion of the toe region or a substantial portion of the toe region and the middle region, and a single longitudinal concavity (as defined below) that occupies a substantial portion of the heel region.

In a preferred embodiment, the invention includes an outsole that, when no load is applied, curves continuously upward in a direction toward the upper beginning at a location near the middle region of the outsole and ending at a location near the rearmost point of the upper. In this preferred embodiment, the upper layer and the lower layer of the midsole each extend from at least the vicinity of the front tip of the shoe to at least the vicinity of the rear tip of the shoe. The upper layer is made from a material having a first density sufficiently dense to support and stabilize the user's foot. Typically, the upper layer has a density between about 0.400 and about 0.500 grams per cubic centimeter and a durometer between about 50 and about 75 on Shore A (ASTM D2240). The upper layer typically has a relatively low compressibility so that it compresses a relatively low, or small, amount under a given load. The lower layer, which may or may not be made of the same material as the upper layer, has a second density that is different from the first density and is sufficiently low in density and high in compressibility so as to allow the lower layer to compress and deform a higher, or greater, amount under a given weight than the upper layer would compress and deform under that same weight. Typically, the lower layer has a density between about 0.325 and about 0.419 grams per cubic centimeter and a durometer between about 15 and about 38 on Shore A (ASTM D2240). The density of the lower layer is sufficiently low and the compressibility of the lower layer is sufficiently high so that under normal walking conditions the user's foot, first in the heel region, then in the middle region, and then finally in the toe region, sinks toward the ground as the lower layer compresses and deforms due to the lower layer's relatively low density and/or high compressibility.

Thus, during walking while wearing a preferred embodiment of the instant invention, when the curved heel region of the outsole strikes the ground, the heel region of the lower layer, which is less dense and more easily compressed than the upper layer, deforms to a relatively large degree compared to the upper layer. After each such initial heel region contact with the ground, the user's heel sinks or moves toward the ground more than it would sink or move in a conventional shoe. This sinking or downward movement is due primarily to deflection of the heel region of the outsole and compression of the heel region of the midsole as they each respond to the increasing weight being transmitted through the user's heel as the step progresses and the user's heel continues to bear an increasing amount of the user's weight until it reaches a maximum. The impact is akin to a heel striking a sandy beach or a giving or uneven surface. Then, as the user's weight begins to shift toward the middle region of the shoe, the shoe rolls forward in a smooth motion, without the user having to overcome any abrupt or discrete pivot points. Then the lower layer of the midsole in the middle region and then in the toe region compresses and deforms under the increasing weight of the user's foot in those regions as the step progresses. This compression and deformation allows the user's foot to sink further toward the ground than would be the case with a conventional shoe. The user then completes the step by pushing off with the forefoot ball area of the user's foot. This push-off further compresses and deforms the lower layer in the toe region.

As used herein, "longitudinal convexities" and "longitudinal concavities" mean, refer to, and are defined as, respectively, convexities and concavities that lie only in vertical, longitudinal planes that extend from any local frontmost point of the shoe to a corresponding local rearmost point of the shoe when the shoe is in its normal, upright position. As used herein, "transverse convexities" and "transverse concavities" mean, refer to, and are defined as, respectively, convexities and concavities that lie only in vertical, transverse planes that extend from any local medialmost point of the shoe to a corresponding local lateralmost point of the shoe when the shoe is in its normal, upright position.

All convexities and concavities in the instant invention, both longitudinal and transverse, are all identified herein as being on, and being a part of, the bottom surface of the upper layer. Under this convention, each longitudinal convexity and each transverse convexity identified herein is, to some degree, an outward bulge of the bottom surface of the upper layer and each longitudinal concavity and each transverse concavity identified herein is, to some degree, an inward depression in the bottom surface of the upper layer. The outward bulge of each longitudinal convexity and of each transverse convexity means that the upper layer is relatively thick wherever it has a longitudinal or transverse convexity. This increased thickness of the upper layer corresponds to a decrease in thickness of the lower layer at each location where the lower layer is opposite a longitudinal convexity or a transverse convexity. Similarly, the inward depression of each longitudinal concavity and of each transverse concavity means that the upper layer is relatively thin wherever it has a longitudinal or transverse concavity. This increased thinness of the upper layer corresponds to a decreased thinness, i.e., a thickening, of the lower layer at each location where the lower layer is opposite a longitudinal concavity or a transverse concavity.

Each convexity and concavity, both longitudinal and transverse, has at least five primary variables that control the effect of each such convexity and each such concavity. These primary variables are (1) the location where each longitudinal and transverse convexity and each longitudinal and transverse concavity is located on the bottom surface of the upper layer, (2) the sharpness or shallowness of each such convexity or concavity, i.e., its radius or radii of curvature, (3) the length or wavelength of each such convexity or concavity as measured from a point where it begins to a point where it ends, (4) the amplitude, i.e., the greatest height of each such convexity or the greatest depth of each such concavity, and (5) the firmness or compressibility of the upper layer material with which each such convexity or concavity is formed. These variables are some of the primary means by which the effects of the shoe on the user are controlled. These effects comprise primarily (1) the degree of softness or hardness felt by the user's foot throughout each step while wearing the shoe, (2) the amount of energy and effort needed for the user to complete each step, and (3) the amount of muscle use, control and coordination necessary for the user to maintain the user's balance throughout each step.

The degree of softness or hardness felt by the user's foot immediately after the heel strike is controlled primarily by a longitudinal concavity located in the heel region. This longitudinal concavity is typically relatively large, i.e., it typically has a long length, a large radius or radii of curvature, and a large amplitude. This relatively large longitudinal concavity allows a relatively thick lower layer to be used in the heel region that can absorb and soften the initial heel strike of each step. Whereas each longitudinal concavity and each transverse concavity imparts a relatively soft feel to the user's foot while walking, each longitudinal convexity and each transverse convexity imparts a relatively hard feel to the user's foot while walking. This relative hardness is due to the decreased thickness of the soft, highly compressible lower layer at each location where a longitudinal or transverse convexity occurs.

The amount of energy and effort required by the user in each step is related to the degree of softness or hardness felt by the user as discussed in the preceding paragraph insofar as each longitudinal or transverse concavity corresponds to a softer feel which, in turn, requires more energy and effort to overcome in each step.

The amount of muscle use, control and coordination necessary for the user to maintain the user's balance throughout each step increases in direct proportion to each one of the following: (1) increased size, primarily in wavelength and amplitude, of the longitudinal concavity and/or transverse concavity and (2) increased compressibility of the lower layer. Increased longitudinal and/or transverse concavity size in the form of greater amplitude corresponds to a thicker lower layer. The compressibility of the lower layer is a physical property inherent in the material out of which the lower layer is made. It is a measure of the readiness with which the lower layer compresses under a given load. A high compressibility means that the lower layer is highly compressible and can be compressed a high amount with relative ease. As the compressibility increases, the user must use more muscle control and coordination to maintain the user's balance during each step as the weight of the user compresses the lower layer. This compression is accompanied by a downward movement of the user's foot as it compresses the lower layer during each step. This downward compression movement requires balancing by the user to accommodate inherent longitudinal and transverse instability that accompanies the compression. This inherent longitudinal and transverse instability is also affected by the thickness of the lower layer. This thickness, as mentioned above, increases as longitudinal and/or transverse concavity size increases. As the thickness of the lower layer increases, the inherent longitudinal and transverse instability increases. Thus, longitudinal concavities and transverse concavities both contribute to a less stable walking nature of the shoe. The relative opposite effect is achieved with a longitudinal convexity and/or a transverse convexity. Each longitudinal convexity and/or transverse convexity in the upper layer corresponds to a relative thinness in the lower layer. This relative thinness in the lower layer means that the user is not required to engage in as much balancing effort as when the lower layer is thick, primarily because the amount of unstableness in the lower layer is decreased, i.e., the stableness of the lower layer is increased, where each longitudinal convexity and/or transverse convexity occurs in the corresponding upper layer. Thus, longitudinal convexities and transverse convexities contribute to a more stable walking nature of the shoe.

One of the primary objectives of shoes having midsoles as disclosed herein is to provide fitness benefits to the user by requiring the user, by merely walking, to exert more energy and effort than would otherwise be required when walking while wearing conventional shoes, and to require the user to use, control, and coordinate muscles in ways that such muscles would not be used, controlled or coordinated when walking while wearing conventional shoes. Just as walking on a sandy beach requires more energy and effort than walking on a hard, flat surface, the relatively thick, highly compressible lower layer of the midsole in the area of a longitudinal concavity and/or a transverse concavity requires that a user wearing shoes having such a midsole exert more energy and effort to walk than is required while wearing conventional shoes. The extra thickness and high compressibility of the lower layer in the area of the longitudinal concavity and, if present, the transverse concavity, further allows the shoes to flex more, both transversely and longitudinally, than conventional shoes. In order for the user to maintain the user's balance and a normal walking gait under such flexure conditions, the user is required to use muscles and to control and coordinate muscles to an extent greater than is required when walking while wearing conventional shoes. The use of such muscles in such a manner further imparts a fitness benefit to the user. These and other fitness benefits of the instant shoe include, among others: muscle strengthening and toning, better posture, improved cardiovascular health, less stress on joints, and improved circulation.

BRIEF DESCRIPTION OF THE DRAWINGS

By way of example only, selected embodiments and aspects of the present invention are described below. Each such description refers to a particular figure ("FIG.") which shows the described matter. All such figures are shown in drawings that accompany this specification. Each such figure includes one or more reference numbers that identify one or more part(s) or element(s) of the invention.

DESCRIPTION OF PREFERRED EMBODIMENTS

Figure 1:
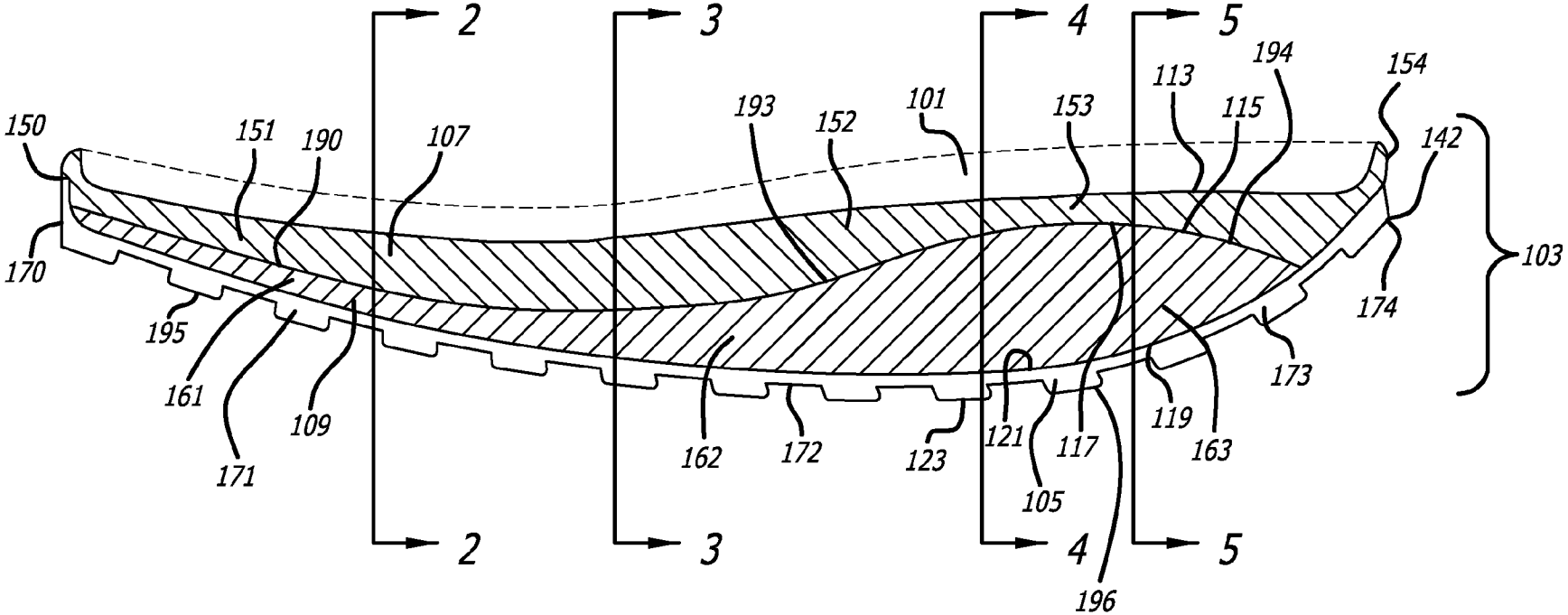
FIG. 1 is a side elevation view in cross section of an embodiment of the midsole and outsole of the shoe.
Figure 1A:
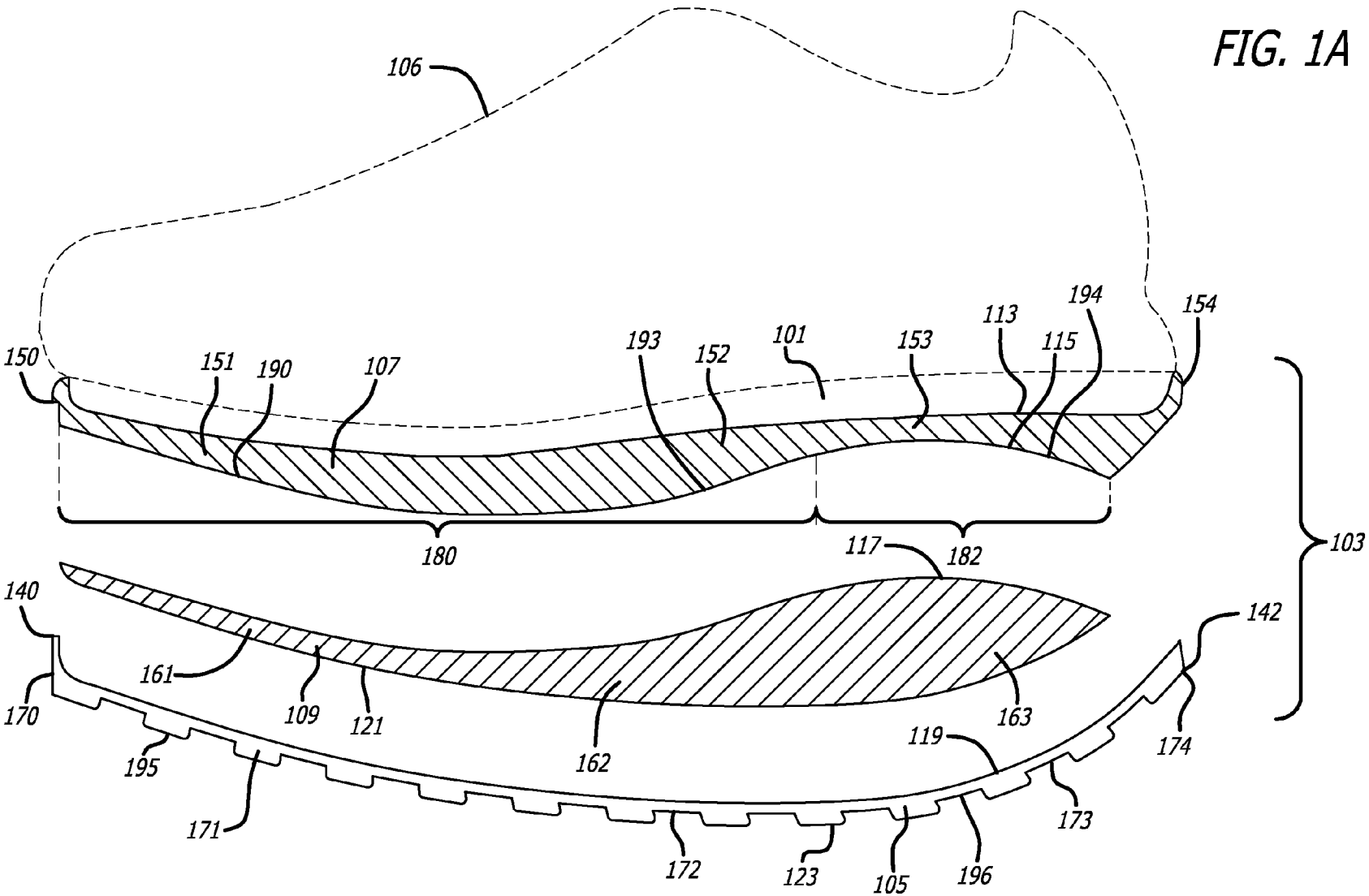
FIG. 1A is an exploded view of FIG. 1.

The invention will now be described with reference to the preferred embodiment shown in FIGS. 1 and 1A. This embodiment shows a shoe upper 106, a midsole 103, and an outsole 105 of the shoe. The outsole 105 is not part of the midsole 103. As shown in FIGS. 1 and 1A, the outsole 105 is below the midsole 103 when the shoe is in its normal, upright position. This normal, upright position is shown with respect to the ground 100 in FIGS. 6B-6D. As used herein, "above" and "below" refer to relative locations of identified elements when the shoe is in this normal, upright position as shown in FIGS. 6B-6D. The midsole 103 is located between the shoe upper 106 and the outsole 105.

Figure 7:
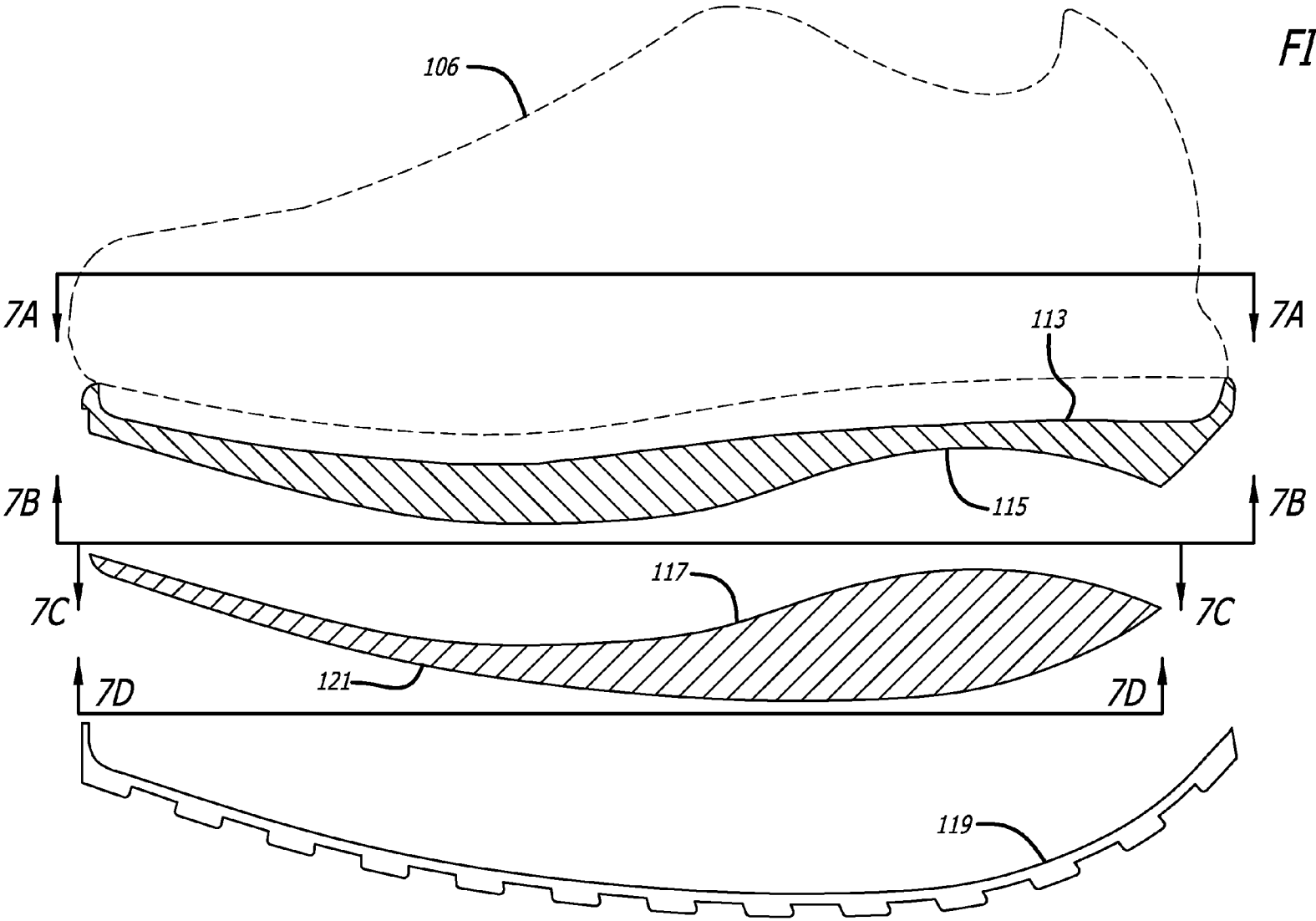
FIG. 7 is an exploded view of FIG. 1 that includes view plane lines.
Figure 7A:
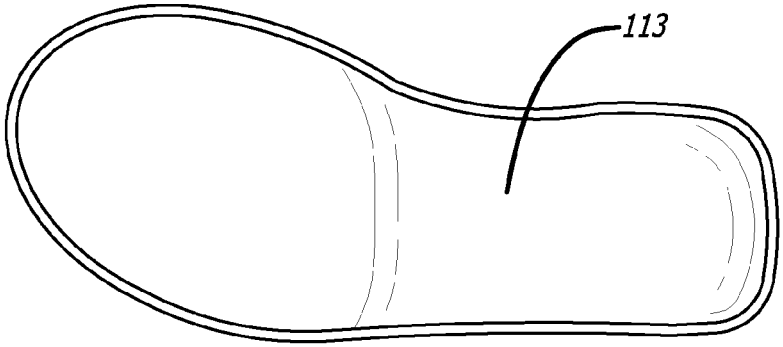
FIG. 7A is a simplified top plan view of the top surface of the upper layer of the midsole along line 7A-7A in the direction of the appended arrows.
Figure 7B:
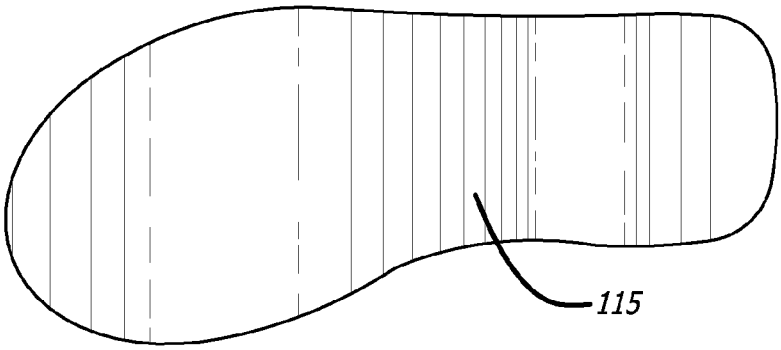
FIG. 7B is a bottom plan view of the bottom surface of the upper layer of the midsole along line 7B-7B in the direction of the appended arrows.
Figure 7C:
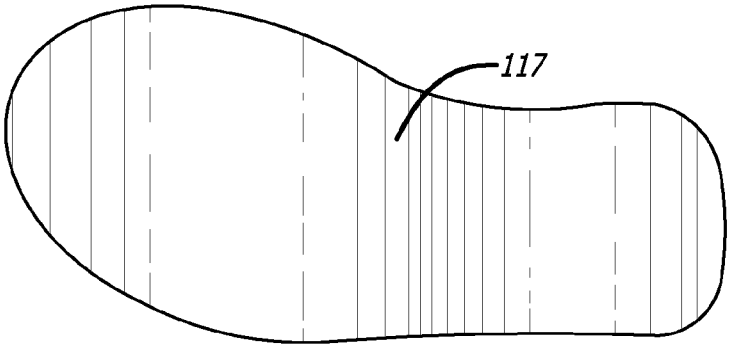
FIG. 7C is a top plan view of the top surface of the lower layer of the midsole along line 7C-7C in the direction of the appended arrows.
Figure 7D:
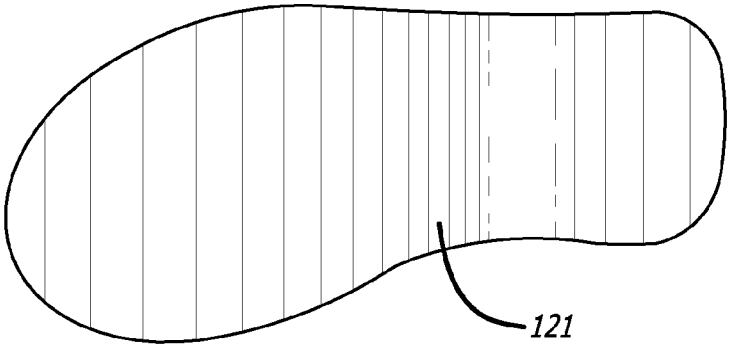
FIG. 7D is a bottom plan view of the bottom surface of the lower layer of the midsole along line 7D-7D in the direction of the appended arrows.

The midsole 103, as shown in FIG. 1A, comprises an upper layer 107 and a lower layer 109. The upper layer 107 and/or the lower layer 109 may each comprise two or more sublayers. The upper layer 107 has a top surface 113 substantially opposite a bottom surface 115. Top surface 113 is shown in FIG. 17A. Bottom surface 115 is shown in FIG. 7B. The lower layer 109 has a top surface 117 substantially opposite a bottom surface 121. Top surface 117 is shown in FIG. 7C. Bottom surface 121 is shown in FIG. 7D. The outsole 105 has a top surface 119 substantially opposite a bottom surface 123. As shown in FIGS. 1 and 1A, when the shoe is in its normal, upright position, the lower layer 109 is below the upper layer 107 and the outsole 105 is below the lower layer 109.

The shoe has a front tip 140 located at the farthest point toward the front of the shoe and a rear tip 142 located at the farthest point toward the rear of the shoe. The upper layer 107 includes a toe region 151 that extends substantially from the medial side of the shoe to the lateral side of the shoe at a location that begins in the vicinity of the front tip 140 and extends from there to a location that is approximately one third of the distance toward the rear tip 142. The lower layer 109 includes a toe region 161 that extends substantially from the medial side of the shoe to the lateral side of the shoe at a location that begins in the vicinity of the front tip 140 and extends from there to a location that is approximately one third of the distance toward the rear tip 142. The outsole 105 includes a toe region 171 that extends substantially from the medial side of the shoe to the lateral side of the shoe at a location that begins in the vicinity of the front tip 140 and extends from there to a location that is approximately one third of the distance toward the rear tip 142.

The upper layer 107 includes a heel region 153 that extends substantially from the medial side of the shoe to the lateral side of the shoe at a location that begins in the vicinity of the rear tip 142 and extends from there to a location that is approximately one third of the distance toward the front tip 140. The lower layer 109 includes a heel region 163 that extends substantially from the medial side of the shoe to the lateral side of the shoe at a location that begins in the vicinity of the rear tip 142 and extends from there to a location that is approximately one third of the distance toward the front tip 140. The outsole 105 includes a heel region 173 that extends substantially from the medial side of the shoe to the lateral side of the shoe at a location that begins in the vicinity of the rear tip 142 and extends from there to a location that is approximately one third of the distance toward the front tip 140.

The upper layer 107 includes a middle region 152 that extends substantially from the medial side of the shoe to the lateral side of the shoe at a location that extends approximately between the toe region 151 and the heel region 153. The lower layer 109 includes a middle region 162 that extends substantially from the medial side of the shoe to the lateral side of the shoe at a location that extends approximately between the toe region 161 and the heel region 163. The outsole 105 includes a middle region 172 that extends substantially from the medial side of the shoe to the lateral side of the shoe at a location that extends approximately between the toe region 171 and the heel region 173.

Typically, the lower layer 109 of the midsole 103 is on average thicker in the heel region 163 than it is in the toe region 161. Typically, the thickness of the lower layer 109 is less than about 45 millimeters thick in the heel region 163 and has an average thickness in the heel region 163 of at least about 6.5 millimeters, and is less than about 25 millimeters thick in the middle region 162 and the toe region 161 and has an average thickness in the middle region 162 and the toe region 161 of at least about 3 millimeters. The upper layer 107 has a first density and the lower layer 109 has a second density different from the first density and is typically less dense than the first density. The upper layer 107 has a first compressibility and the lower layer 109 has a second compressibility that is different from the first compressibility. The compressibility of the lower layer 109 is typically relatively high. Due to this relatively high compressibility, the lower layer 109 undergoes a relatively high amount of deformation when subjected to a given load. The upper layer 107 is typically made from polyurethane, polyvinyl chloride, rubber or thermal plastic rubber. However, the upper layer 107 can be made from any other material without departing from the scope of the present invention. Typically the upper layer 107 will have a density of between about 0.400 and about 0.500 grams per cubic centimeter and a durometer between about 50 and about 75 Shore A (ASTM D2240). The lower layer 109 is made of a compressible and deformable yet resilient material which may or may not be the same material of which the upper layer 107 is made. Typically the lower layer 109 will have a density of between about 0.325 and about 0.419 grams per cubic centimeter and a durometer between about 15 and about 38 Shore A (ASTM D2240). The top surface 113 of the upper layer 107 is typically positioned below an insole board (not shown) which is typically positioned below a sockliner 101. The upper layer 107 has a bottom surface 115 that may be connected to the top surface 117 of the lower layer 109 by either friction and/or an adhesive and/or other similar means. Alternatively, substantially the entire bottom surface 115 of the upper layer 107 may be molded to substantially the entire top surface 117 of the lower layer 109.

The bottom surface 115 of the upper layer 107, as shown in FIG. 1A, has a longitudinal convexity 180 that comprises at least a downward curve 190 located in at least a portion of the toe region 151. "Downward curve," as used here and throughout this specification, unless otherwise noted, refers to a direction that moves toward the ground 100 from any specified location on the shoe when viewed while moving from the front tip 140 to the rear tip 142 and while the shoe is oriented in its typical upright position where the bottom surface 123 of the outsole 105 is in unloaded contact with the ground 100. The upper layer has a frontmost point 150 and a rearmost point 154. Downward curve 190 of longitudinal convexity 180 begins at, or near the vicinity of, the frontmost point 150 of the upper layer 107 and gradually and continuously descends downwardly from there through at least a portion of the toe region 151. The portion of the upper layer 107 indicated by lines extending from, and associated with, reference numeral 180 indicates the approximate range wherein longitudinal convexity 180 is typically primarily located. Longitudinal convexity 180 may, or may not, be entirely located within the range indicated by the lines extending from, and associated with, reference numeral 180. Longitudinal convexity 180, as shown in FIG. 1A, is relatively shallow due to its large radius, or radii, of curvature. Longitudinal convexity 180 may comprise a curve or curves in addition to downward curve 190. The radius of curvature throughout longitudinal convexity 180 may be completely constant, may have one or more constant portions mixed with one or more non-constant portions, or may be completely non-constant. Downward curve 190, as well as any other curve or curves that are part of longitudinal convexity 180, may, at any point on any of those curves, have a slope 6 somewhere between negative infinity and positive infinity and can include a slope that is zero, gradual, moderate, steep, vertical, horizontal or somewhere between any of those amounts. Although downward curve 190 of longitudinal convexity 180 is shown in FIG. 1A as beginning near the frontmost point 150, downward curve 190 of longitudinal convexity 180 may instead begin at some other location on the upper layer 107. Although longitudinal convexity 180 is shown in FIG. 1A as ending at a location in the middle region 152 or the location where the middle region 152 transitions into the heel region 153, longitudinal convexity 180 may end at some other location on the upper layer 107.

The bottom surface 115 of the upper layer 107, as shown in FIG. 1A, has a longitudinal concavity 182 that comprises at least a portion of an upward curve 193 located in at least a portion of the heel region 153. "Upward curve," as used here and throughout this specification, unless otherwise noted, refers to a direction that moves away from the ground 100 from any specified location on the shoe when viewed while moving from the front tip 140 to the rear tip 142 and while the shoe is oriented in its typical upright position where the bottom surface 123 of the outsole 105 is in unloaded contact with the ground 100. In this preferred embodiment, longitudinal concavity 182 further comprises at least a downward curve 194. Upward curve 193 may or may not be contiguous with downward curve 194. Upward curve 193 ascends upwardly in at least a portion of the heel region 153. Downward curve 194 descends downwardly in at least a portion of the heel region 153. The portion of the upper layer 107 indicated by lines extending from, and associated with, reference numeral 182 indicates the approximate range wherein longitudinal concavity 182 is typically primarily located. Longitudinal concavity 182 may, or may not, be entirely located within the range indicated by the lines extending from, and associated with, reference numeral 182. Longitudinal concavity 182 may comprise a curve or curves in addition to a portion of upward curve 193 and downward curve 194. The radius of curvature throughout longitudinal concavity 182 may be completely constant, may have one or more constant portions mixed with one or more non-constant portions, or may be completely non-constant. Upward curve 193, downward curve 194, as well as any other curve or curves that are part of longitudinal concavity 182, may, at any point on any of those curves, have a slope somewhere between negative infinity and positive infinity and can include a slope that is zero, gradual, moderate, steep, vertical, horizontal or somewhere between any of those amounts. Although upward curve 193 is shown in FIG. 1A as beginning at a location where the toe region 151 and the middle region 152 transition into one another, upward curve 193 could instead begin at some other location on the upper layer 107. Although upward curve 193 is shown in FIG. 1A as ending at a location in the heel region 153, upward curve 193 may instead end at some other location on the upper layer 107. Although downward curve 194 is shown in FIG. 1A as beginning in the heel region 153 and ending in the vicinity of the rearmost point 154 of the upper layer 107, downward curve 194 may instead begin at some other location on the upper layer 107 and end at some other location on the upper layer 107. Longitudinal convexity 180 may or may not be contiguous with longitudinal concavity 182.

In another embodiment, the upper layer 107 has a bottom surface 115A. Bottom surface 115A differs from bottom surface 115 in that bottom surface 115, as can be seen in FIGS. 2, 3, 4, and 5, is straight when viewed along a transverse axis at any location along its surface. As used herein, a transverse axis is a straight line that extends from the medial side of the shoe to the corresponding lateral side of the shoe in a plane that is parallel to the ground 100 when the shoe is not bearing any load and is in its normal, upright orientation. Some examples of such transverse axes are indicated by the straight lines that represent bottom surface 115 in FIG. 7B, the straight lines that represent top surface 117 in FIG. 7C, and the straight lines that represent bottom surface 121 in FIG. 7D. As can be seen in FIGS. 2A-5A, however, bottom surface 115A is convex when viewed along a transverse axis at any location along bottom surface 115A. This convex shape of bottom surface 115A forms a transverse convexity 186 which is shown in FIGS. 2A-5A. Transverse convexity 186 lies only in vertical, transverse planes that extend from any local medialmost point of the shoe to a corresponding local lateralmost point of the shoe at any location between the front tip 140 and the rear tip 142 when the shoe is in its normal, upright position. When transverse convexity 186 is present, it is present in addition to longitudinal convexity 180 and longitudinal concavity 182. When bottom surface 115A is present, lower layer 109 has a top surface 117A that substantially conforms to and mirrors bottom surface 115A. Transverse convexity 186 may be located in any portion or portions of the toe region 151, middle region 152 or heel region 153 of the upper layer 107. Transverse convexity 186 may also be present throughout the entire upper layer 107. The shape of transverse convexity 186 may be any shape as described herein for longitudinal convexity 180. In any given bottom surface 115A, the shape of transverse convexity 186 may change as the location of transverse convexity 186 changes with respect to the front tip 140 and the rear tip 142.

In another embodiment, the upper layer 107 has a bottom surface 115B. As can be seen in FIGS. 2B-5B, bottom surface 115B is concave when viewed along a transverse axis at any location along bottom surface 1115B. This concave shape of bottom surface 115B forms a transverse concavity 187 which is shown in FIGS. 2B-5B. Transverse concavity 187 lies only in vertical, transverse planes that extend from any local medialmost point of the shoe to a corresponding local lateralmost point of the shoe at any location between the front tip 140 and the rear tip 142 when the shoe is in its normal, upright position. When transverse concavity 187 is present, it is present in addition to longitudinal convexity 180 and longitudinal concavity 182. When bottom surface 115B is present, lower layer 109 has a top surface 117B that substantially conforms to and mirrors bottom surface 115B. Transverse concavity 187 may be located in any portion or portions of the toe region 151, middle region 152 or heel region 153 of the upper layer 107. Transverse concavity 187 may also be present throughout the entire upper layer 107. The shape of transverse concavity 187 may be any shape as described herein for longitudinal concavity 182. In any given bottom surface 115B, the shape of transverse concavity 187 may change as the location of transverse concavity 187 changes with respect to the front tip 140 and the rear tip 142. In any given bottom surface 115B, transverse concavity 187 may be present in addition to transverse convexity 186. In any given bottom surface 115A, transverse convexity 186 may be present in addition to transverse concavity 187.

The outsole 105 may curve upwardly in the heel region. The outsole 105 has a frontmost point 170 and a rearmost point 174. When the shoe is in its typical upright, unloaded state, the frontmost point 170 and the rearmost point 174 are both relatively high above the ground 100. From a point at or near the vicinity of the frontmost point 170, the outsole 105 has a gradual downward curve 195 that continues through at least a portion of the toe region 171 of the outsole 105. Starting in the middle region 172, the outsole 105 has a gradual, upward curve 196 that continues to curve upward through at least a portion of the heel region 173 of the outsole 105. This gradual upward curve 196 typically continues until the outsole 105 approaches the vicinity of the rear tip 142 of the shoe. This upward curve 196 is typically sharper than downward curve 195 in the toe region 171. Upward curve 196 may be substantially sharper than shown in FIG. 1A or substantially shallower than shown in FIG. 1A. The outsole 105 has a bottom surface 123 that typically contains grooves and/or patterns for optimal traction and wear.

Figure 2:
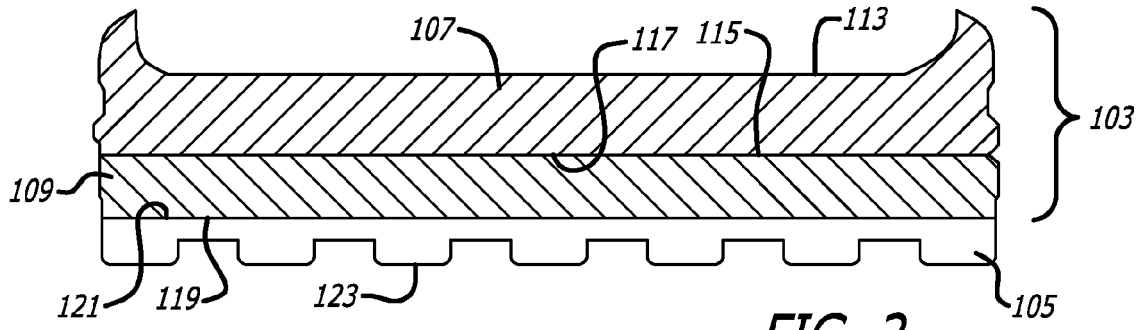
FIG. 2 is a front elevation view in cross section of the midsole and outsole of the shoe in FIG. 1 along line 2-2 in the direction of the appended arrows.
Figure 2A:
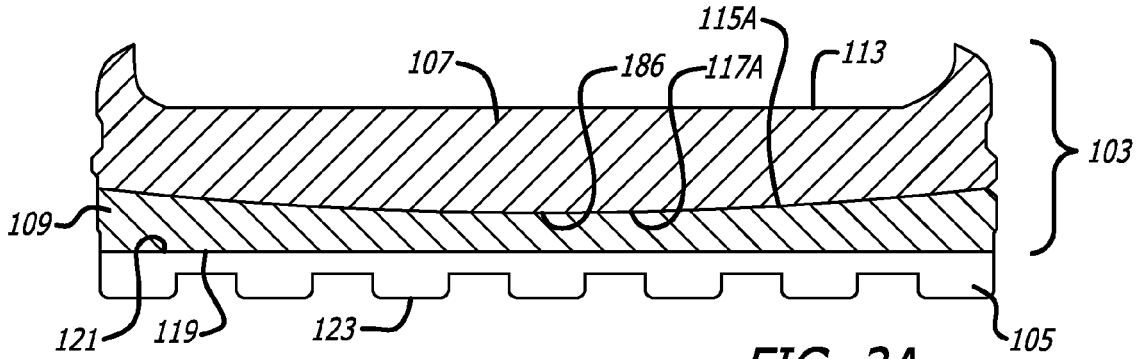
FIG. 2A is a front elevation view in cross section of an alternative embodiment of the midsole and outsole of the shoe in FIG. 1 along line 2-2 in the direction of the appended arrows.
Figure 2B:
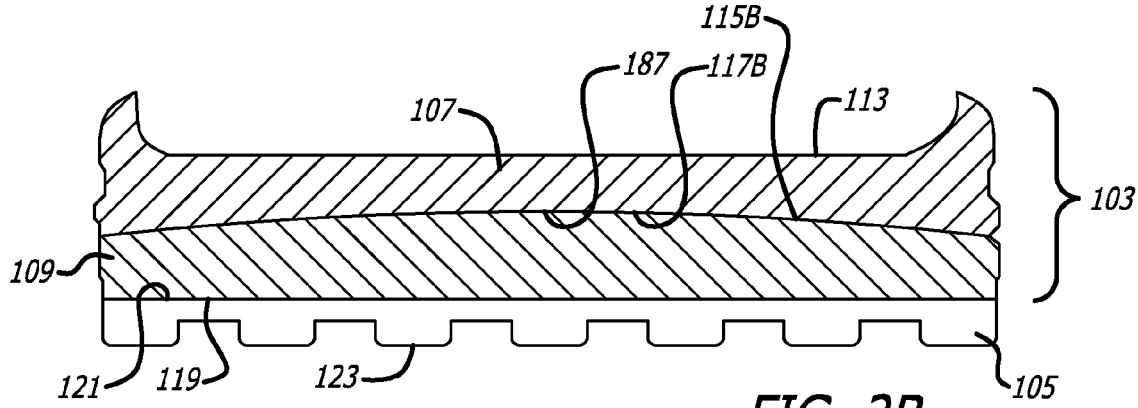
FIG. 2B is a front elevation view in cross section of another alternative embodiment of the midsole and outsole of the shoe in FIG. 1 along line 2-2 in the direction of the appended arrows.

FIG. 2 shows a front elevation view in cross section of the midsole 103 shown in FIG. 1 along line 2-2 in the direction of the appended arrows. As shown in FIG. 2, the bottom surface 115 of the upper layer 107 substantially conforms to and mirrors the top surface 117 of the lower layer 109. The shape of the bottom surface 115 and the top surface 117 at line 2-2 is shown in FIG. 2 by a substantially horizontal line that extends from the lateral side of the midsole 103 to the medial side.

Figure 3:
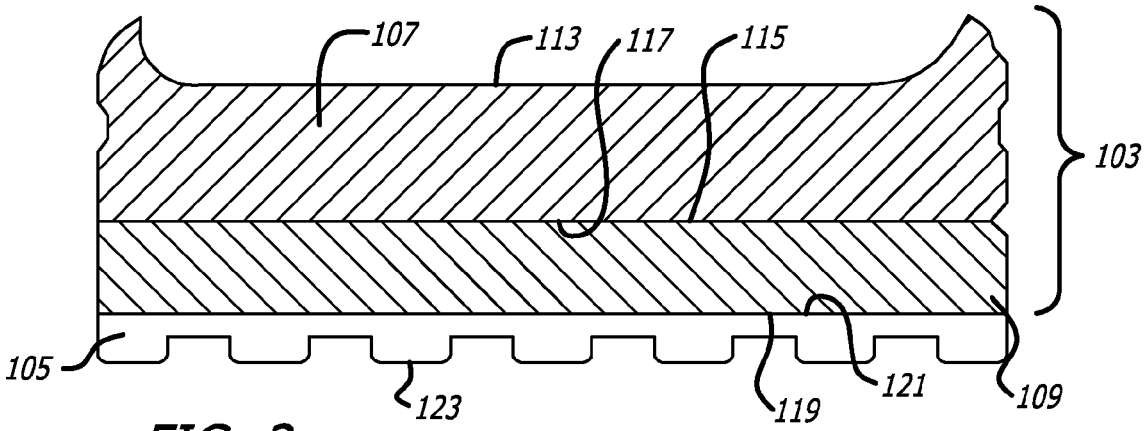
FIG. 3 is a front elevation view in cross section of the midsole and outsole of the shoe in FIG. 1 along line 3-3 in the direction of the appended arrows.
Figure 3A:
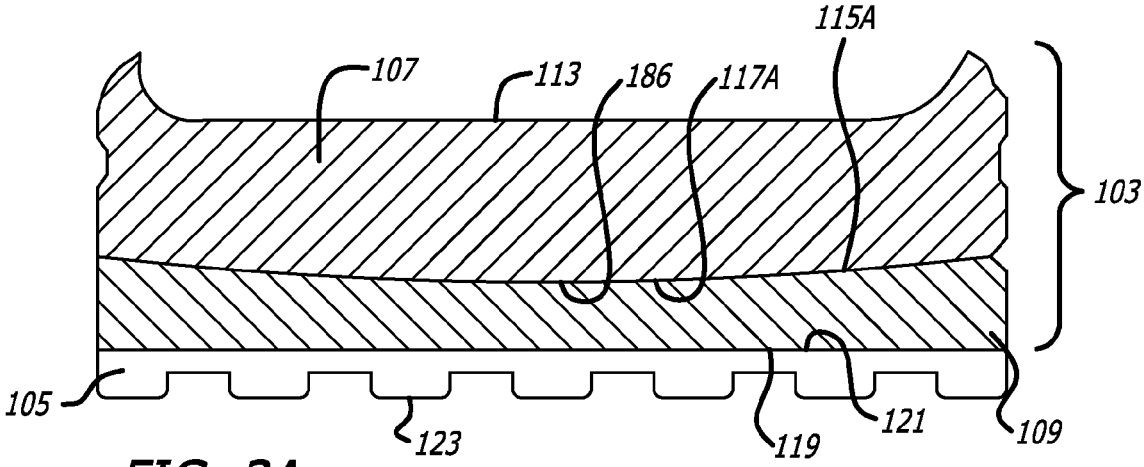
FIG. 3A is a front elevation view in cross section of an alternative embodiment of the midsole and outsole of the shoe in FIG. 1 along line 3-3 in the direction of the appended arrows.
Figure 3B:
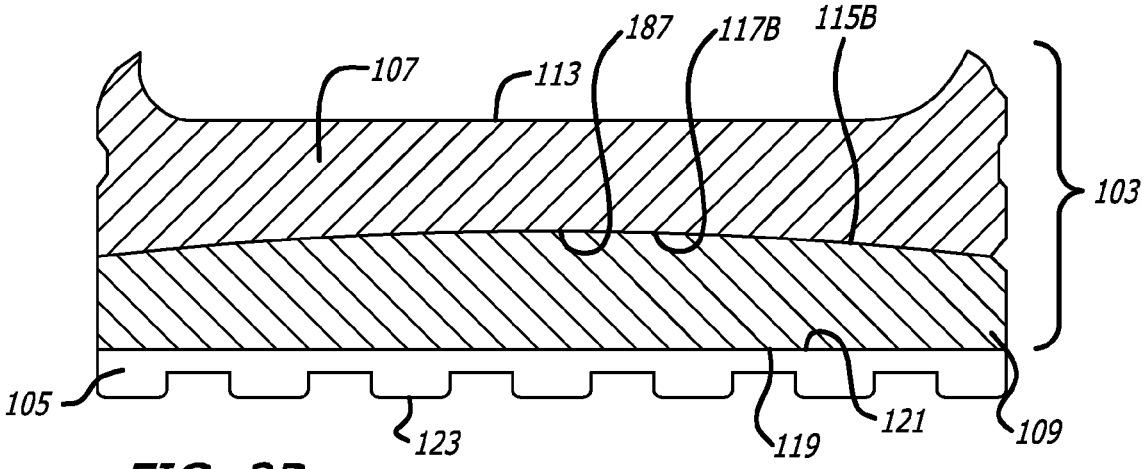
FIG. 3B is a front elevation view in cross section of another alternative embodiment of the midsole and outsole of the shoe in FIG. 1 along line 3-3 in the direction of the appended arrows.

FIG. 3 shows a front elevation view in cross section of the midsole 103 shown in FIG. 1 along line 3-3 in the direction of the appended arrows. As shown in FIG. 3, the bottom surface 115 of the upper layer 107 substantially conforms to and mirrors the top surface 117 of the lower layer 109. The shape of the bottom surface 115 and the top surface 117 at line 3-3 is shown in FIG. 3 by a substantially horizontal line that extends from the lateral side of the midsole 103 to the medial side.

Figure 4:
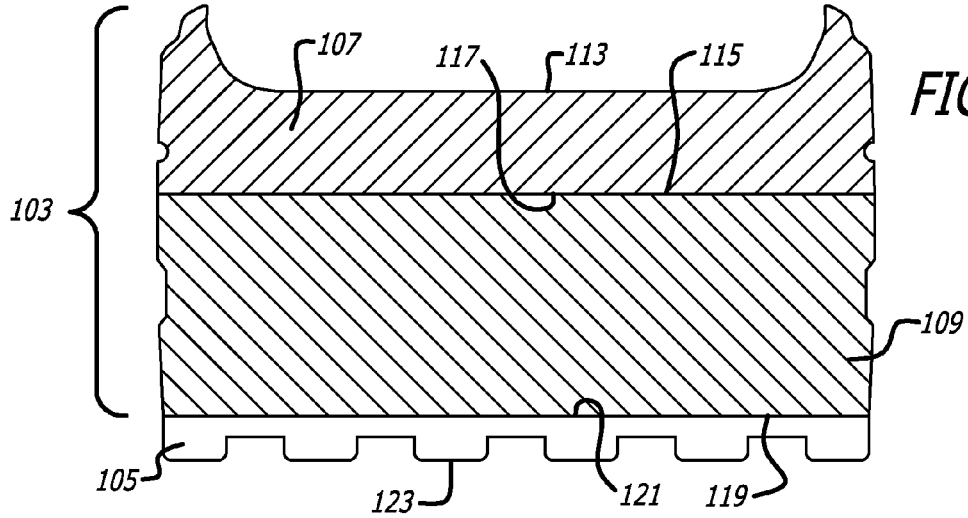
FIG. 4 is a front elevation view in cross section of the midsole and outsole of the shoe in FIG. 1 along line 4-4 in the direction of the appended arrows.
Figure 4A:
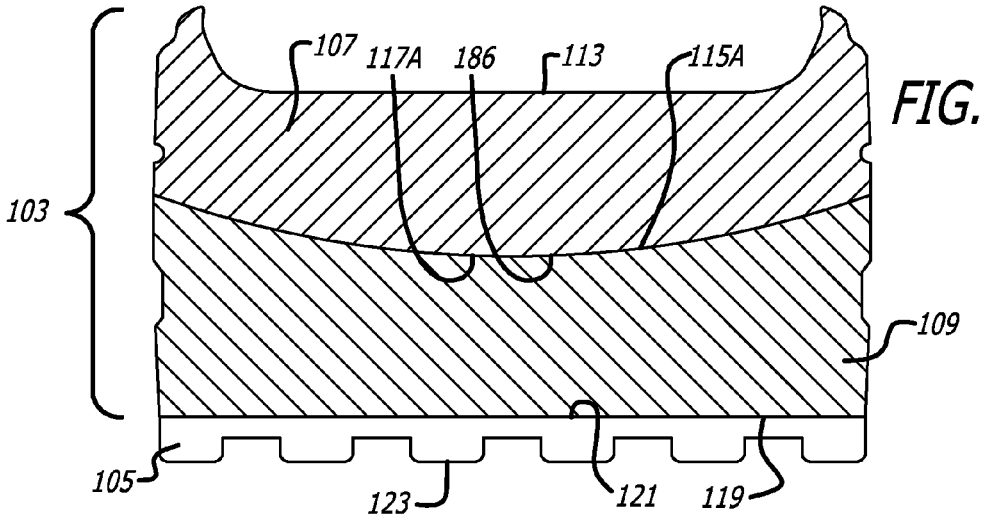
FIG. 4A is a front elevation view in cross section of an alternative embodiment of the midsole and outsole of the shoe in FIG. 1 along line 4-4 in the direction of the appended arrows.
Figure 4B:
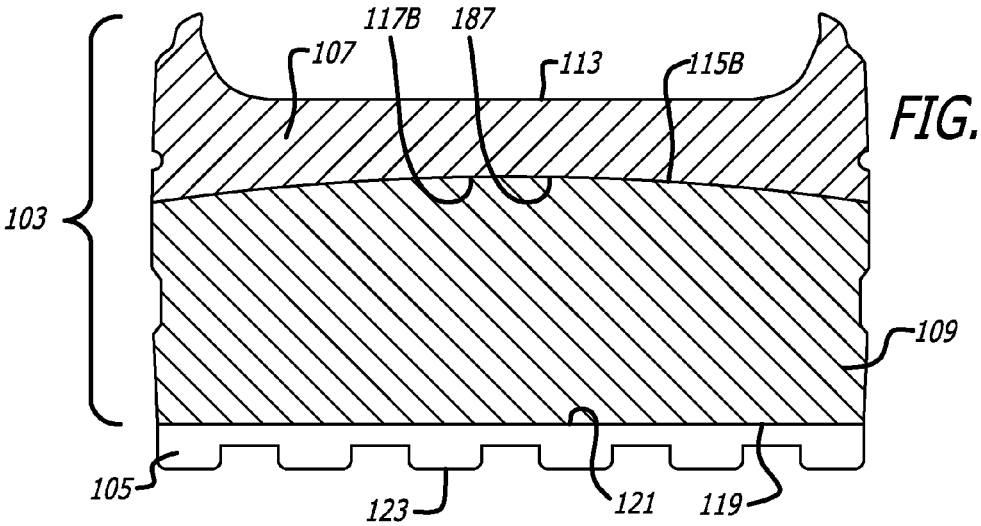
FIG. 4B is a front elevation view in cross section of another alternative embodiment of the midsole and outsole of the shoe in FIG. 1 along line 4-4 in the direction of the appended arrows.

FIG. 4 shows a front elevation view in cross section of the midsole 103 shown in FIG. 1 along line 4-4 in the direction of the appended arrows. As shown in FIG. 4, the bottom surface 115 of the upper layer 107 substantially conforms to and mirrors the top surface 117 of the lower layer 109. The shape of the bottom surface 115 and the top surface 117 at line 4-4 is shown in FIG. 4 by a substantially horizontal line that extends from the lateral side of the midsole 103 to the medial side.

Figure 5:
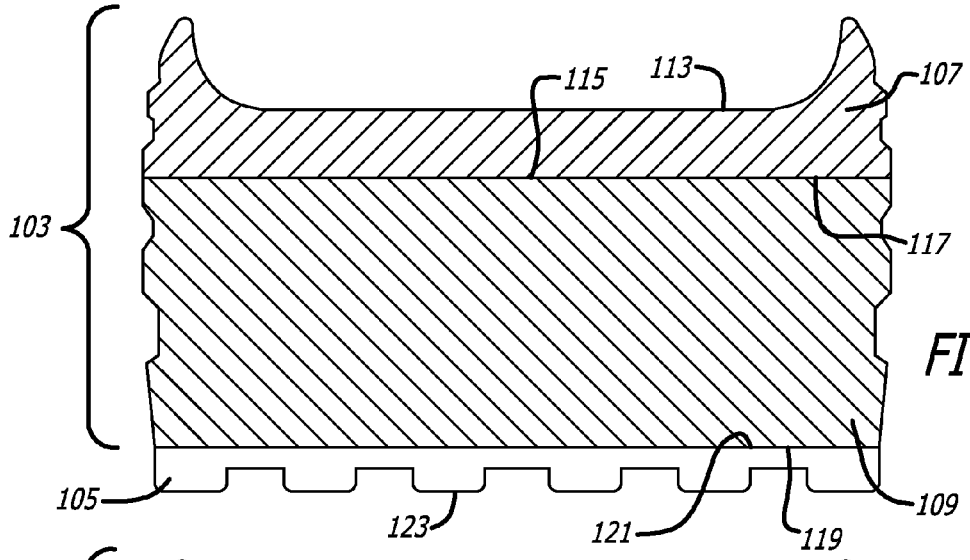
FIG. 5 is a front elevation view in cross section of the midsole and outsole of the shoe in FIG. 1 along line 5-5 in the direction of the appended arrows.
Figure 5A:
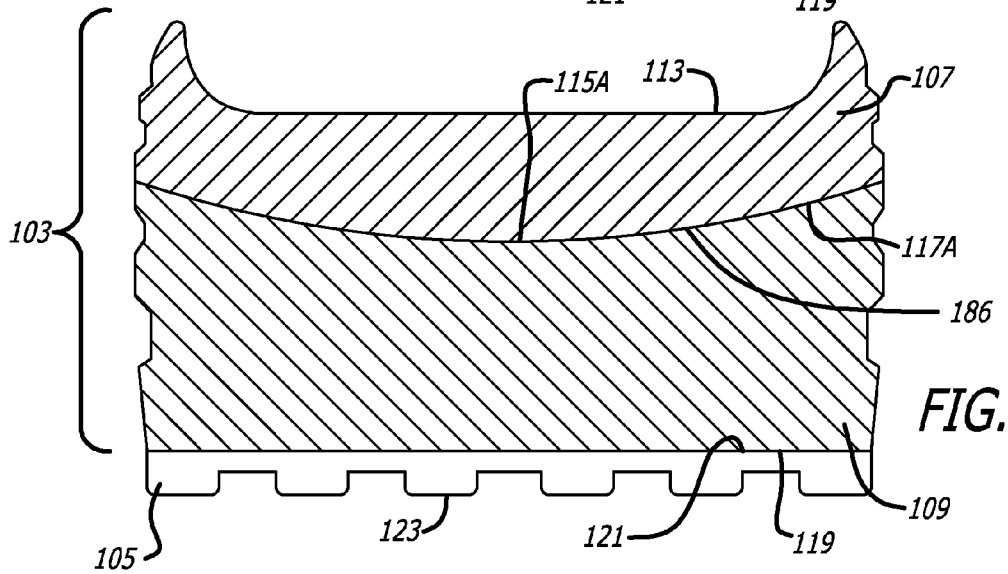
FIG. 5A is a front elevation view in cross section of an alternative embodiment of the midsole and outsole of the shoe in FIG. 1 along line 5-5 in the direction of the appended arrows.
Figure 5B:
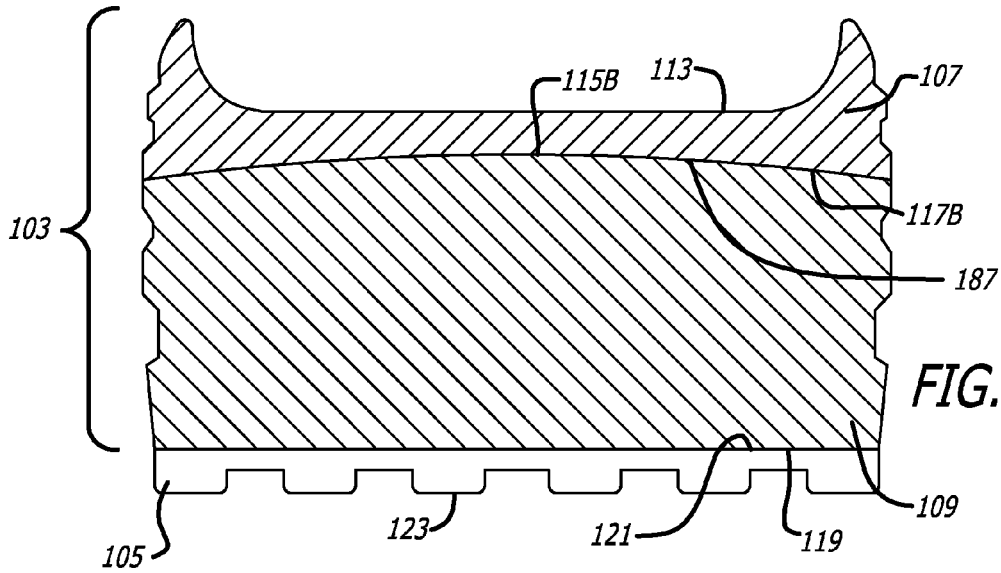
FIG. 5B is a front elevation view in cross section of another alternative embodiment of the midsole and outsole of the shoe in FIG. 1 along line 5-5 in the direction of the appended arrows.

FIG. 5 shows a front elevation view in cross section of the midsole 103 shown in FIG. 1 along line 5-5 in the direction of the appended arrows. As shown in FIG. 5, the bottom surface 115 of the upper layer 107 substantially conforms to and mirrors the top surface 117 of the lower layer 109. The shape of the bottom surface 115 and the top surface 117 at line 5-5 is shown in FIG. 5 by a substantially horizontal line that extends from the lateral side of the midsole 103 to the medial side.

As shown in cross sections in FIGS. 1-5, the thickness of the midsole 103 varies and generally increases from the toe regions 151 and 161 to the heel regions 153 and 163.

In preferred embodiments, the top surface 117 of the lower layer 109 of the midsole 103 is in substantially continuous contact with the bottom surface 115 of the upper layer 107 of the midsole 103. Due to this substantially continuous contact between top surface 117 and bottom surface 115 in these preferred embodiments, top surface 117 substantially conforms to and mirrors bottom surface 115. In other embodiments, such substantially continuous contact between top surface 117 and bottom surface 115 may not be present.

In normal use of the shoe, each forward step taken by the user begins when the heel region 173 of the outsole 105 begins to make contact with the ground 100. The lower layer 109 of the midsole 103 in the heel region 163 that is made of less dense and more readily compressible material then begins to compress and deform, allowing the heel of the user's foot to sink toward the ground 100 to a greater extent than it would sink while wearing a conventional shoe. Due to longitudinal concavity 182, the lower layer 109 is relatively thick in the heel region 163. Since this relatively thick heel region 163 of the lower layer 109 is also relatively soft and highly compressible, it mimics the effect of walking on a sandy beach, thereby requiring the user to exert more energy while walking than would be required when walking while wearing conventional shoes. Additionally, since the heel region 163 of the lower layer 109 is relatively thick and highly compressible, it has a degree of inherent longitudinal and transverse instability that is not present in conventional shoes. This inherent instability forces the user to engage in a balancing effort and use muscles and muscle control and coordination to maintain a normal walking gait that would not be required with conventional shoes.

As the step continues, the user's weight shifts to the middle regions 152, 162, and 172 and the shoe rolls forward in a smooth motion without the user having to overcome any abrupt pivot point. The lower layer 109 of the midsole 103 in the middle region 162 then compresses and deforms, allowing the user's foot in that region to sink toward the ground 100 more than it would sink if the user were wearing conventional shoes. As the step continues, the user's weight then shifts to the toe regions 151, 161, and 171. The lower layer 109 of the midsole 103 in the toe region 161 then compresses and deforms, allowing the user's foot in that region to sink toward the ground 100 more than it would sink if the user were wearing conventional shoes. As shown in the toe region 151 and middle region 152 in FIG. 1, longitudinal convexity 180 limits and decreases the thickness of the highly compressible lower layer 109 in the corresponding toe region 161 and middle region 162 of the lower layer 109. This decrease in thickness of the lower layer 109 results in an increase in stability in the toe region 161 and middle region 162. The user then completes the step by pushing off with the forefoot ball of the user's foot. All of this simulates the effect, and imparts the fitness benefits, of walking on a sandy beach or on a giving or uneven soft surface regardless of the actual hardness of the surface.

Figure 6A:
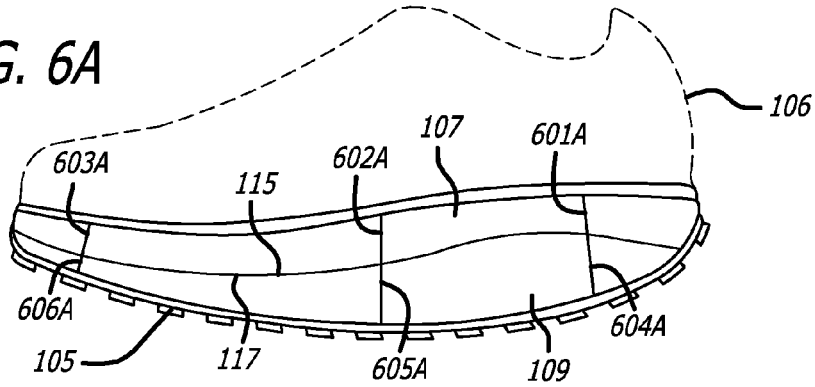
FIG. 6A is a side elevation view of a representative shoe that embodies the instant invention and bears no load.
Figure 6B:
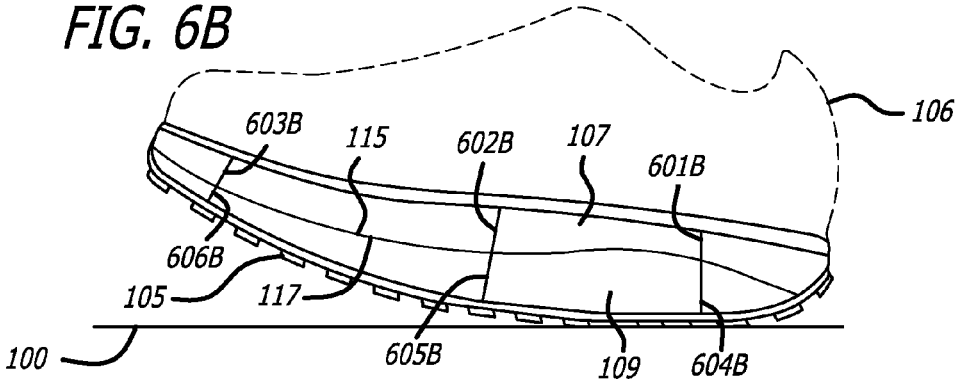
FIG. 6B is a side elevation view of the shoe of FIG. 6A showing the heel region bearing the load of a user.
Figure 6C:
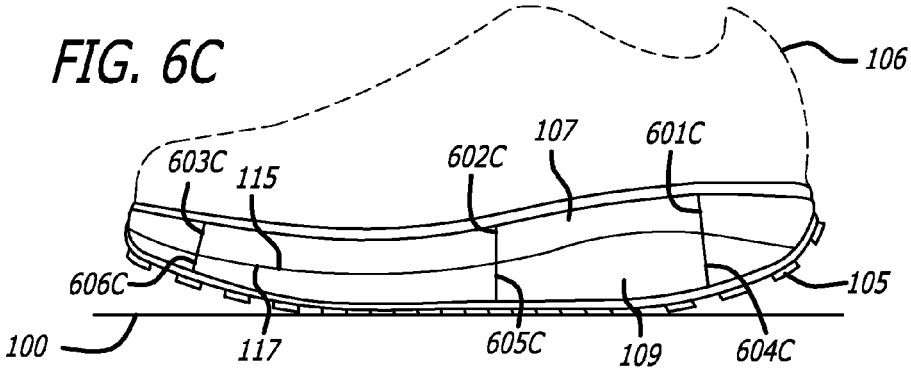
FIG. 6C is a side elevation view of the shoe of FIG. 6A showing the middle region bearing the load of a user.
Figure 6D:
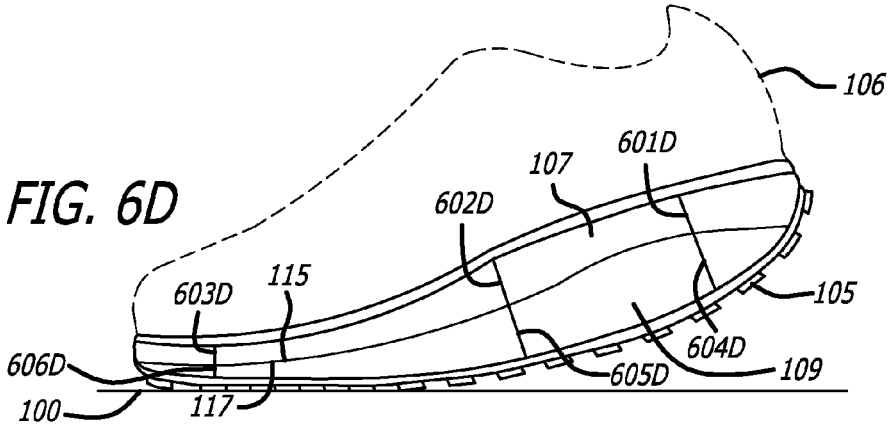
FIG. 6D is a side elevation view of the shoe of FIG. 6A showing the toe region bearing the load of a user.

FIGS. 6A-6D show a side elevation exterior view of a representative shoe that embodies the instant invention. This exterior view includes a curved line that corresponds to the shape of the bottom surface 115 of the upper layer 107 and further corresponds to the shape of top surface 117 of the lower layer 109. This curved line is indicated by reference numerals 115 and 117. FIG. 6A shows this representative shoe in a fully unloaded state. FIGS. 6B, 6C, and 6D show this representative shoe undergoing normal loading that occurs when a user walks while wearing the shoe.

In FIGS. 6A-6D, the straight lines identified by, respectively, reference numerals 601A-601D, 602A-602D, and 603A-603D each represent the thickness of the upper layer 107 at the location where each such straight line 601A-601D, 602A-602D, and 603A-603D appears. The straight lines identified by, respectively, reference numerals 604A-604D, 605A-605D, and 606A-606D each represent the thickness of the lower layer 109 at the location where each such straight line 604A-604D, 605A-605D, and 606A-606D appears.

As shown in the unloaded state in FIG. 6A, the upper layer 107 and lower layer 109 are not undergoing any compression. As also shown in FIG. 6A, the outsole 105 is not undergoing any deflection or deformation. In this fully uncompressed state, the thickness of the upper layer 107 and the thickness of the lower layer 109 are each at their respective maximum thickness. This maximum thickness is indicated by, and corresponds to, the length of each straight line 601A-606A, each one of which is at its maximum length as shown in FIG. 6A.

FIG. 6B shows the representative shoe in an orientation where the user's heel (not shown) is imparting a load in the heel regions 153, 163, and 173, shown in FIGS. 1 and 1A. Under this loading condition, the heel region 153 of the upper layer 107 is undergoing a relatively small amount of compression. This relatively small amount of compression results in a relatively small decrease in the thickness of the heel region 153 of the upper layer 107. This relatively small decrease in thickness is indicated by 601B. Under this same loading, the heel region 163 of the lower layer 109 is undergoing a relatively large amount of compression. This relatively large amount of compression results in a relatively large decrease in the thickness of the heel region 163 of the lower layer 109. This relatively large decrease in thickness is indicated by 604B. Under this same loading, the heel region 173 of the outsole 105 is undergoing a relatively large amount of deflection. This relatively large amount of deflection in the heel region 173 of the outsole 105 is caused by the heel region 173 conforming to the ground 100 as it bears the load of the user. This deflection and conformity of the heel region 173 of the outsole 105 is indicated by the straight portion of the outsole 105 where it contacts the ground 100 as shown in FIG. 6B.

FIG. 6C shows the representative shoe in an orientation where the user's foot (not shown) is imparting a load in the middle regions 152, 162, and 172, shown in FIGS. 1 and 1A. Under this loading condition, the middle region 152 of the upper layer 107 is undergoing a relatively small amount of compression. This relatively small amount of compression results in a relatively small decrease in the thickness of the middle region 152 of the upper layer 107. This relatively small decrease in thickness is indicated by 602C. Under this same loading, the middle region 162 of the lower layer 109 is undergoing a relatively large amount of compression. This relatively large amount of compression results in a relatively large decrease in the thickness of the middle region 162 of the lower layer 109. This relatively large decrease in thickness is indicated by 605C. Under this same loading, the middle region 172 of the outsole 105 is undergoing a relatively large amount of deflection. This relatively large amount of deflection in the middle region 172 of the outsole 105 is caused by the middle region 172 conforming to the ground 100 as it bears the load of the user. This deflection and conformity of the middle region 172 of the outsole 105 is indicated by the straight portion of the outsole 105 where it contacts the ground 100 as shown in FIG. 6C.

FIG. 6D shows the representative shoe in an orientation where the user's foot (not shown) is imparting a load in the toe regions 151, 161, and 171, shown in FIGS. 1 and 1A. Under this loading condition, the toe region 151 of the upper layer 107 is undergoing a relatively small amount of compression. This relatively small amount of compression results in a relatively small decrease in the thickness of the toe region 151 of the upper layer 107. This relatively small decrease in thickness is indicated by 603D. Under this same loading, the toe region 161 of the lower layer 109 is undergoing a relatively large amount of compression. This relatively large amount of compression results in a relatively large decrease in the thickness of the toe region 161 of the lower layer 109. This relatively large decrease in thickness is indicated by 606D. Under this same loading, the toe region 171 of the outsole 105 is undergoing a relatively large amount of deflection. This relatively large amount of deflection in the toe region 171 of the outsole 105 is caused by the toe region 171 conforming to the ground 100 as it bears the load of the user. This deflection and conformity of the toe region 171 of the outsole 105 is indicated by the straight portion of the outsole 105 where it contacts the ground 100 as shown in FIG. 6D.

While the foregoing detailed description sets forth selected embodiments of a shoe in accordance with the present invention, the above description is illustrative only and not limiting of the disclosed invention. The claims that follow herein collectively cover the foregoing embodiments. The following claims further encompass additional embodiments that are within the scope and spirit of the present invention.

What is claimed is:

1. A shoe having an upper, a midsole, and an outsole, wherein said midsole comprises:

a toe region, a middle region, a heel region, an upper layer, and a lower layer, wherein said upper layer has a bottom surface and said lower layer has a top surface, said lower layer being located substantially between the outsole and the upper layer, the bottom surface of said upper layer substantially facing the top surface of said lower layer, said bottom surface of said upper layer having a single longitudinal convexity and a single longitudinal concavity wherein the single longitudinal convexity occupies a substantial portion of the toe region and the single longitudinal concavity occupies a substantial portion of the heel region, said upper layer and said lower layer each having a density wherein the density of the upper layer is denser than the density of the lower layer, and said upper layer having a durometer greater than 60 Shore A.

2. The shoe of claim 1 wherein the bottom surface of the upper layer has a transverse convexity.

3. The shoe of claim 1 wherein the bottom surface of the upper layer has a transverse concavity.

4. A shoe having an upper, a midsole, and an outsole, wherein said midsole comprises:

a toe region, a middle region, a heel region, an upper layer, and a lower layer, wherein said upper layer has a bottom surface and said lower layer has a top surface, said lower layer being located substantially between the outsole and the upper layer, the bottom surface of said upper layer substantially facing the top surface of said lower layer, said bottom surface of said upper layer having a longitudinal convexity and a longitudinal concavity wherein the longitudinal convexity occupies a substantial portion of the toe region, said upper layer and said lower layer each having a density wherein the density of the upper layer is denser than the density of the lower layer, and said upper layer having a durometer greater than 60 Shore A.

5. The shoe of claim 4 wherein the bottom surface of the upper layer has a transverse convexity.

6. The shoe of claim 4 wherein the bottom surface of the upper layer has a transverse concavity.

7. A shoe having an upper, a midsole, and an outsole, wherein said midsole comprises:

a toe region a middle region, a heel region, an upper layer, and a lower layer, wherein said upper layer has a bottom surface and said lower layer has a top surface, said lower layer being located substantially between the outsole and the upper layer, the bottom surface of said upper layer substantially facing the top surface of said lower layer, said bottom surface of said upper layer having a longitudinal convexity and a longitudinal concavity wherein the longitudinal convexity occupies a substantial portion of the toe region, said upper layer and said lower layer each having a density wherein the density of the upper layer is denser than the density of the lower layer, and the bottom surface of said upper layer having a transverse convexity or a transverse concavity.

* * * * *

UNITED STATES PATENT AND TRADEMARK OFFICE

CERTIFICATE OF CORRECTION

PATENT NO. : 7,779,557 B2
APPLICATION NO. : 12/557276
DATED : August 24, 2010
INVENTOR(S) : Savva Teteriatnikov, Eckhard Knoepke and Julie Zhu It is certified that error appears in the above-identified patent and that said Letters Patent is hereby corrected as shown below:

Column 12,
Line 40, reads "and middle region 152 in FIG. 1, longitudinal convexity 180"

Should read -- and middle region 152 in FIG. 1A, longitudinal convexity 180 --

Signed and Sealed this

Twenty-sixth Day of October, 2010

David J. Kappos

David J. Kappos
*Director of the United States Patent and Trademark Office*